US005307546A

United States Patent [19]

Dilo

[11] Patent Number: 5,307,546

[45] Date of Patent: May 3, 1994

[54] APPARATUS FOR FEEDING A FIBER BATT TO A NEEDLE LOOM

[75] Inventor: Johann P. Dilo, Eberbach, Fed. Rep. of Germany

[73] Assignee: Oskar Dilo Maschinenfabrik KG, Eberbach, Fed. Rep. of Germany

[21] Appl. No.: 925,510

[22] Filed: Aug. 4, 1992

[30] Foreign Application Priority Data

Aug. 29, 1991 [DE] Fed. Rep. of Germany ..... 4'28734

[51] Int. Cl.[5] ..... D04H 18/00

[52] U.S. Cl. ..... 28/107; 28/111; 271/272

[58] Field of Search ..... 28/107, 110, 115, 114, 28/111, 112, 109; 26/18.6; 271/264, 272, 198, 8.1, 7; 226/200

[56] References Cited

U.S. PATENT DOCUMENTS

| | | | |
|---|---|---|---|
| 1,770,252 | 7/1930 | Robertson et al. | 28/107 |
| 2,177,604 | 10/1939 | Stone | 28/107 |
| 3,540,096 | 11/1970 | Keine | 28/110 |
| 3,621,540 | 11/1971 | Morrill | 28/107 |
| 3,837,054 | 9/1974 | Fehrer | 28/107 |
| 3,921,266 | 11/1975 | Fehrer | 28/107 |
| 4,042,655 | 8/1977 | Platt et al. | 28/107 |
| 4,187,586 | 2/1980 | Semjonow | 28/107 |

FOREIGN PATENT DOCUMENTS

| | | | |
|---|---|---|---|
| 0388072 | 3/1990 | European Pat. Off. . | |
| 2053863 | 5/1971 | Fed. Rep. of Germany . | |
| 2945872 | 11/1979 | Fed. Rep. of Germany . | |
| 2081737 | 2/1971 | France . | |
| 2265896 | 3/1975 | France . | |
| 1213446 | 11/1970 | United Kingdom | 28/107 |

*Primary Examiner*—Clifford D. Crowder
*Assistant Examiner*—Amy B. Vanatta
*Attorney, Agent, or Firm*—Rosen, Dainow & Jacobs

[57] ABSTRACT

Apparatus for feeding a fiber batt to a needle loom, in which a gusset gap is filled between the reversing roller of an upper pre-compression conveyor band and an upper supply roller by means of a slim transmission roller, which is suspended at its length at several locations, in order to avoid sagging. The suspensions can consist of ribbons, which carry the transmission roller, or they can be formed by holding fingers which are integrally formed with guide fingers of a finger roller and which are located in respective circumferential grooves in the transmission roller. In an alternative the transmission roller is divided into several segments and roller bearings are provided at the connection positions of the segments and are suspended from above (FIG. 1).

20 Claims, 8 Drawing Sheets

APPARATUS FOR FEEDING A FIBER BATT TO A NEEDLE LOOM

FIELD OF THE INVENTION

The invention relates to an apparatus for feeding a fiber batt to a needle loom.

BACKGROUND OF THE INVENTION

Such feed devices for needle looms are to feed a batt of staple fibers or endless fibers coming from a batt laying device in a possibly draft-reduced way to the first needle row of the needle loom for the subsequent needling operation. Drafts have harmful effects on the batt uniformity and thus on the batt quality. Each draft increases the differences in the mass distribution. Thick areas remain thick, thin areas are drawn even thinner.

A well known feed apparatus consists of an endless base conveyor band, on which the fiber batt is situated, an endless precompression conveyor band which is arranged above it and two so-called finger rollers, i.e. supply rollers, arranged downstream of said bands and having a plurality of circumferential grooves distributed in longitudinal direction of the rollers, in which plastic rings are slidably arranged at which fingers are formed, which extend in tangential direction of the rings in direction towards the needle loom and thus bridge over the gusset gap between the roller nip of the pair of finger rollers and the needle loom, more precisely the holding-down appliance and the needle board of the needle loom, so that the fiber batt in a compressed condition slides through these fingers, without suffering considerable drafts. A similar gusset gap bridge-over, which is formed by wires, which extend through grooves in the supply rollers, is described in U.S. Pat. No. 3,621,540.

These devices for feeding a fiber batt, however, have the disadvantage, that between the pre-compression device, which is usually formed of said two approaching endless conveyor bands, which are running over reversing rollers, as described above, and the finger rollers, upper and lower gusset gaps remain which have a triangular cross-section and which are not bridged-over, and into which the bulky fiber batt bulges in and thereby affect the fiber batt transport. The fiber batt elastically widened into the gusset gaps has to be drawn out of them, which results in the known disadvantageous drafts.

For the improvement of this situation it is already known to bridge-over the lower gusset gap, which is formed between the lower base conveyor band, running around a respective reversing roller, and the lower finger roller, by means of a transmission roller of a smaller diameter, which is situated in the gusset gap and essentially fills it. This transmission roller simply leans on the base conveyor band and the lower finger roller under friction and is supported by them at its total length, so that it cannot bend through. It is preferably driven individually, in order to release the fiber batt from the base band at its way from the base band to the lower finger roller and to transmit it to the finger roller. No solution has so far been offered for bridging-over the upper gusset gap, which remained between the pre-compression conveyor band and the upper finger roller.

SUMMARY OF THE INVENTION

The invention is based on the object, to provide a feed apparatus of the above mentioned kind, in which the above mentioned gusset gap is bridged-over in a way, in that no batt bulge occurs which disrupts the batt transport.

According to the invention an apparatus for supplying a fiber batt to a needle loom is provided, comprising a pre-compression means including a batt support means and an endless pre-compression conveyor band arranged above it and revolving endlessly, which extends in transport direction of the fiber batt at the outlet end of the pre-compression means via a reversing roller, and a pair of supply rollers, which are arranged above each other, forming a nip and located between the pre-compression means and an intake of the needle loom, with the upper supply roller being close to said reversing roller, so that between the pre-compression band guided around the reversing roller and the upper supply roller a gusset gap of approximately triangular cross-section is formed, wherein a slim transmission roller of low surface friction is located in the gusset gap, the circumference of said transmission roller being close to the surface of the pre-compression conveyor band and the upper supply roller or at least contacts one of the pre-compression conveyor band and the supply roller, several bearing means being distributed along the transmission roller by which the transmission roller is suspended for avoiding sagging said transmission roller (19) being driven in the same direction as the upper reversing roller and the supply roller.

The invention makes use of the idea already known from the bridge-over of the lower gusset gap, to essentially fill the gusset gap by means of a transmission roller. While, however, in respect to the support of the lower transmission roller no problems are occurring, since it contacts the base conveyor band situated on the lower reversing roller with its entire length and the lower finger roller, the problem occurs with respect to a transmission roller arranged in the upper gusset gap, in that this roller, due to its slim shape, has a sag, which can be quite considerable at working widths of up to 13 m and more. The invention provides solutions, namely in the form of bearing means, which are distributed along the length of the transmission roller and at which the transmission roller is suspended.

According to an embodiment of the invention, the transmission roller consists of several segments, axially arranged after one another and fixedly connected to one another, and at the connection portions the transmission roller is provided with a rotational bearing, preferably a roller bearing, the outer bearing bush of which is suspended at a suspension means extending through the gap between the finger roller and the pre-compression conveyor band in upward direction.

Surprisingly it was found, that bearing means can be realized in a simple way by narrow suspension ribbons of poor friction coefficient, in which the transmission roller is directly located and which are suspended through the gap between the pre-compression conveyor band and the upper finger roller from above and which also contact the pre-compression conveyor band and the upper supply roller, without troubles occurring. The friction between the transmission roller or the suspension ribbons on one hand and the upper finger roller on the other hand can be considerably deleted as soon as the upper supply roller is generally formed as a finger roller having guide fingers, with the rings supported in the circumferential grooves of the finger rollers and provided with the guide fingers, having a somewhat larger outer diameter than the finger roller supporting them. The ribbons thus are contacting these rings and the transmission roller thus has a lesser distance to the circumferential surface of the finger roller. Alternatively, the transmission roller can comprise flat circumferential grooves in which said ribbons are located, and it contacts the rings, so that a pinching of the ribbons between the transmission roller and the circumference of the finger roller is avoided.

In an alternative embodiment at least some, but preferably all fingers of a correspondingly equipped upper finger roller are elongated backwardly, i.e. opposite to the supply direction of the fiber batt and their ends are bent hook-like in upward direction. They form support fingers having receptions for the transmission roller, which is provided with corresponding circumferential grooves, into which these support fingers engage. In case of a respective elasticity of the material of the finger it can be provided, that the transmission roller is held by the hook-like ends of the holding finger in a locked way. Alternatively the mentioned hook-like ends can be flexibly arranged at the holding fingers and are drawn upwardly by suspension means engaging them. The holding fingers can be elongated projecting over the transmission roller opposite to the feed direction of the fiber batt, in order to at least partially bridge over the remaining gusset-like gap between the pre-compression band and the transmission roller.

It is furthermore advantageous if the circumference of the transmission roller is slightly projecting between the holding fingers over the plane defined by the lower side of the holding fingers in downward direction, in order to improve the batt transport.

BRIEF DESCRIPTION OF THE DRAWINGS

The invention will now be described with reference to the embodiments shown in the drawings: wherein.

DETAILED DESCRIPTION OF THE INVENTION

Figure 1:
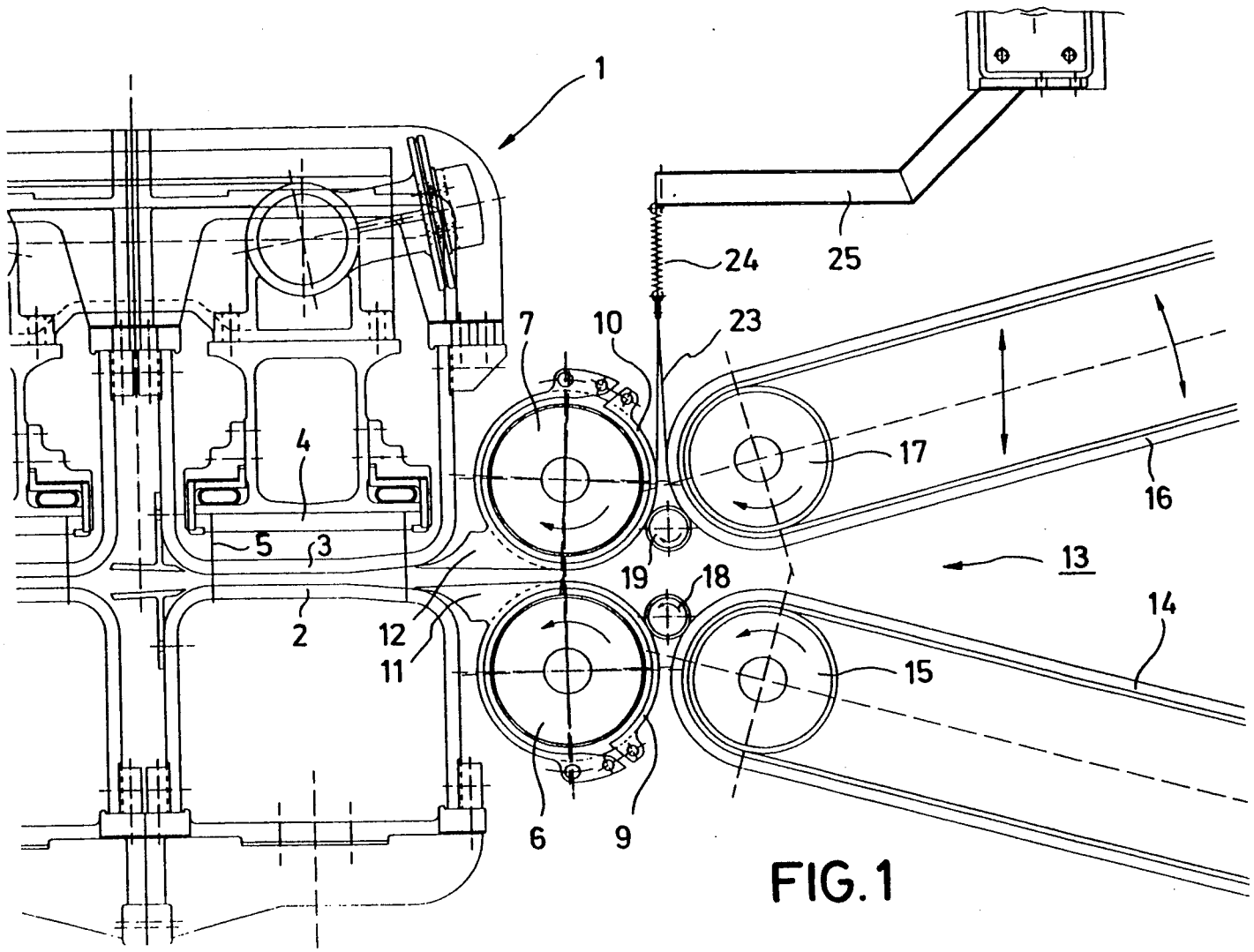
FIG. 1 is a schematic side view of the intake area of a needle loom with the end of a pre-compression means and a pair of finger rollers and with two transmission rollers in the gusset gap between the pre-compression bands and the finger rollers.

In FIG. 1 the intake area of a needle loom 1 with a needle plate 2, a holding down appliance 3 and a needle bar 4 able to move up and down can be seen, to which a plurality of needles 5 are attached, with only two being shown in the example for reasons of simplification. On the intake side of the needle loom 1, two supply rollers are arranged, i.e. a lower supply roller 6 and an upper supply roller 7. They are formed as so-called finger rollers, i.e. they have a plurality of grooves 8, formed at regular spacings in longitudinal direction to their circumference (FIG. 3) in each of which an open, elastic ring 9 and 10, respectively, is loosely located which consists of a low friction plastic material, on which a finger 11 and 12, respectively is formed, which extends in the tangential direction away from ring 9, and 10, respectively in direction towards the intake of the needle loom 1 between the needle plate 2 and the holding down appliance 3.

In the direction towards the pair of finger rollers 6, 7 there is a pre-compression means generally characterized by the numeral 13, consisting of a lower base conveyor band 14, which runs over a lower reversing roller 15, and of an upper pre-compression conveyor band 16, which runs over an upper reversing roller 17. In the gusset gap formed between the base conveyor band 14 and the lower finger roller 6, said gusset gap having an approximately triangular cross-section, there is a lower transmission roller 18 which is driven in the same direction as the base conveyor band 14 and the lower finger roller 6, e.g. via a chain drive, which drivingly connects the lower finger roller 6 with the lower transmission roller 18.

This construction is known so far.

Figure 3:
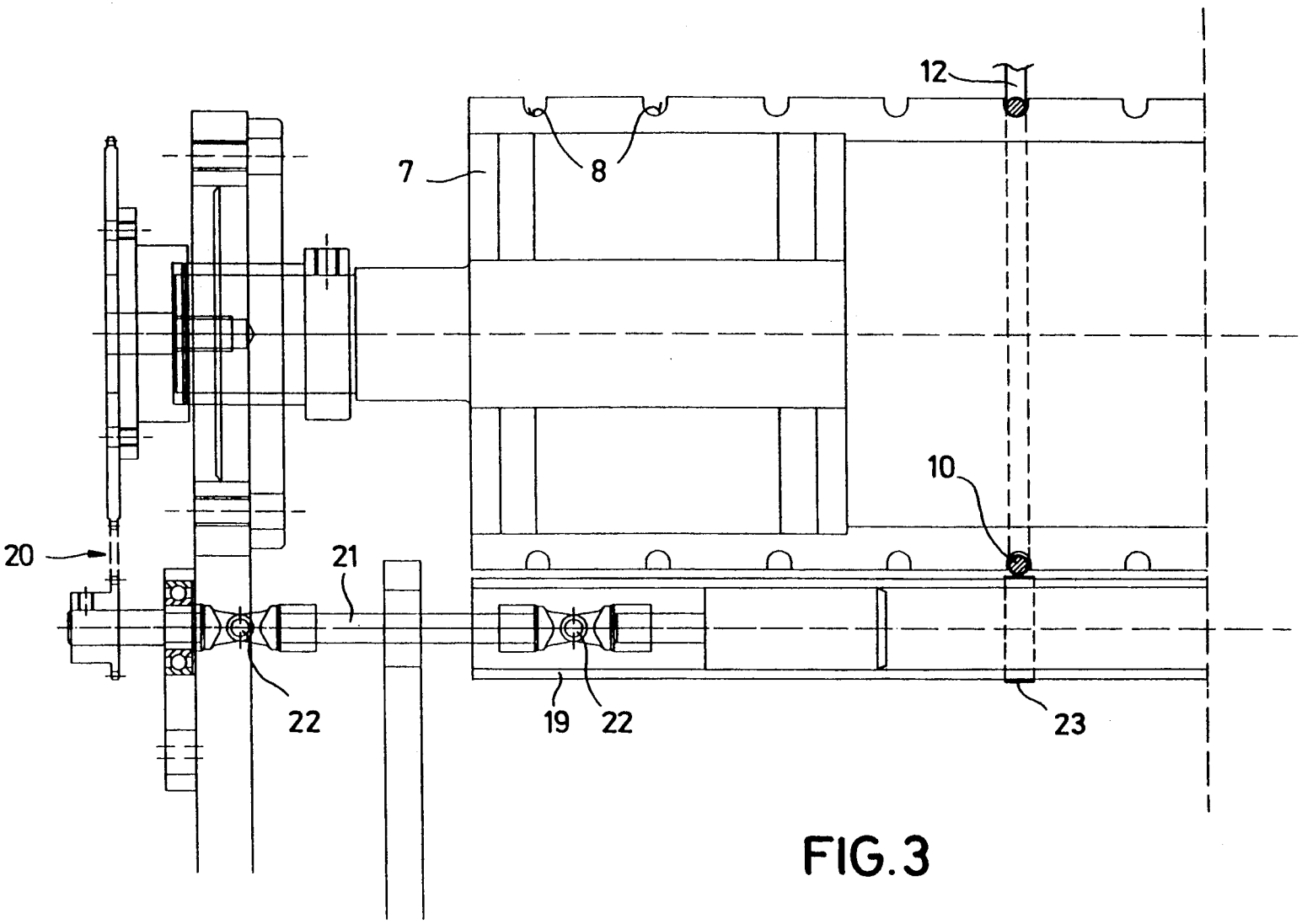
FIG. 3 and 4 are schematic top views of the finger roller and the transmission roller and show lateral supports of the transmission roller and show at the same time the drive for the transmission roller.

In the upper gusset gap, which is formed between the pre-compression conveyor band 16 at the upper reversing roller 17 and the upper finger roller 7, there is an upper transmission roller 19 according to the present invention, which is driven in the same direction as the pre-compression conveyor band 16 and the respective finger roller 7. The drive of the upper transmission roller 19 is preferably carried out via a chain drive 20 by the upper finger roller 7, said chain drive 20 connecting the latter drivingly with the upper transmission roller 19. In order to enable a certain radial movability of the upper transmission roller 19, which is necessary to adjust the distance to the base conveyor band 14 by lowering the pre-compression band 16, the power transmission of chain drive 20 to the upper transmission roller 19 according to FIG. 3 is carried out preferably by the aid of a joint shaft 21 including universal joints 22.

Figure 2:
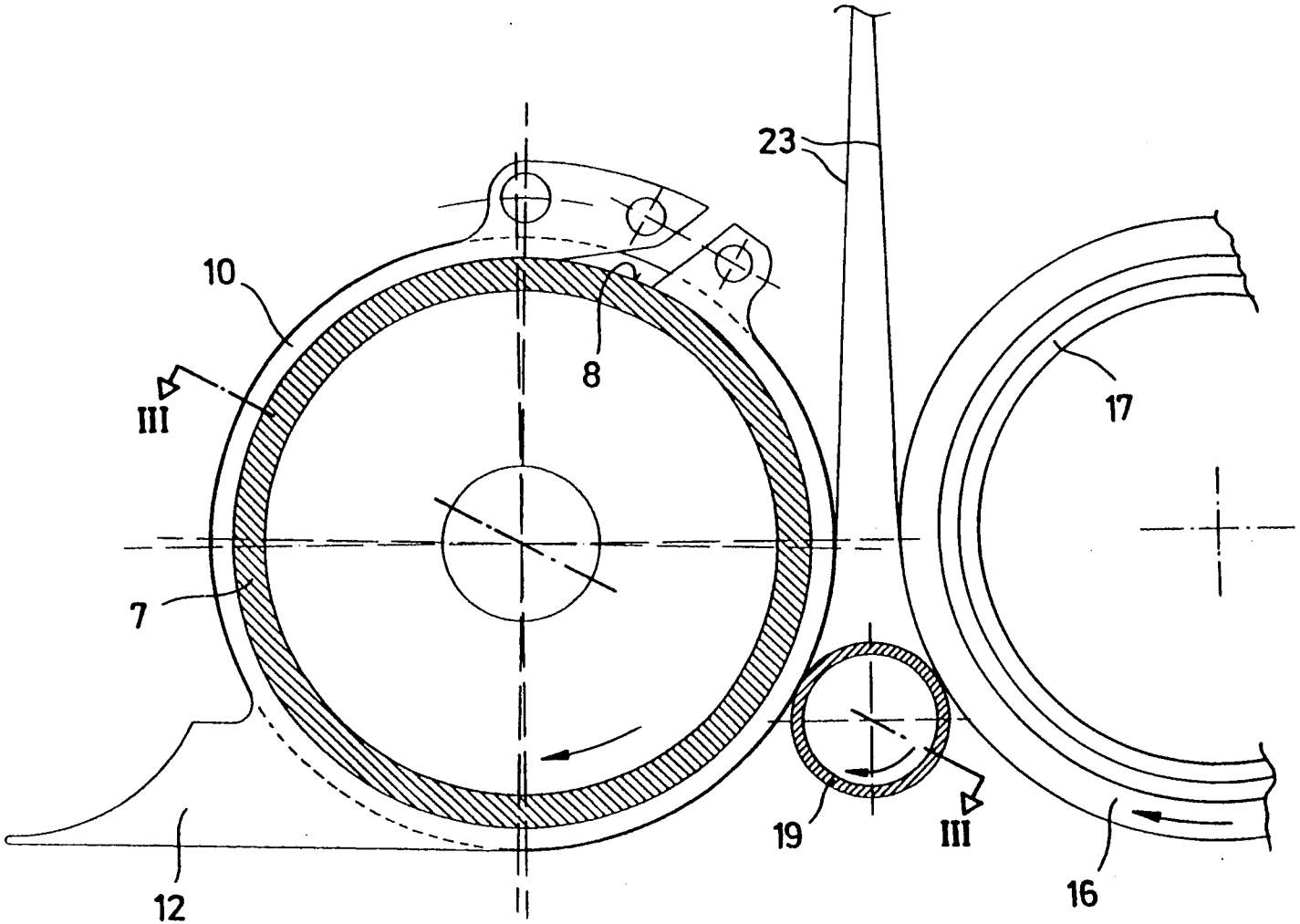
FIG. 2 is a radial sectional view of a section of FIG. 1 and shows details of a first embodiment for the suspension of the transmission roller.

In the embodiment according to FIG. 1, a section of which is shown in enlarged scale in FIG. 2, the upper transmission roller 19 is suspended at various positions in the longitudinal direction thereof by narrow flexible ribbons 23, which surround the transmission roller 19 and which directly contact its surface. These ribbons 23 extend through the gap between the pre-compression band 16 located at the reversing roller 17 and the upper finger roller 7 and are suspended by a spring means 24 located at a carrier 25 fixedly connected with the machine. The spring means 24 support the upper transmission roller 19 and the ribbons 23 are in contact with the pre-compression conveyor band 16 and the finger roller 17 and at the same time enable a vertical movement of the transmission roller 19 in case it is necessary to adjust of height of the upper reversing roller.

The surface of the upper transmission roller 19 is preferably friction-reduced, it can be a polished or plastic-coated roller, with polyethylene and polytetrafluoroethylene being especially advantageous as coating materials. The ribbons 23, by which the upper transmission roller is suspended, also consist of a friction-reduced material, e.g. polyethylene, especially highly drawn polyethylene or polytetrafuoroethylene or polyethylene coated with this material. These ribbons can under certain circumstances be reinforced with a tissue. The ribbons 23 are preferably arranged with regular spacing, which can be in the range of 50 cm. Other spacings are also possible. They depend upon the rigidity and the length of the upper transmission roller 19 which, as already mentioned, can be up to 13 meters or even longer. The width of the each ribbon 23 can be approximately 10 mm.

Surprisingly, it was observed, that despite this kind of suspension of the upper transmission roller 17, the rotation thereof with friction as well as of the pre-compression conveyor band 16 and of the upper finger roller 9 at the ribbons 23 does not have any negative influences. On the other hand, it is possible to reduce the frictional influences even more when the rings 10, which surround the upper finger roller 7, have an outer diameter which is slightly larger than that of the finger roller 7 in question.

Figure 4:
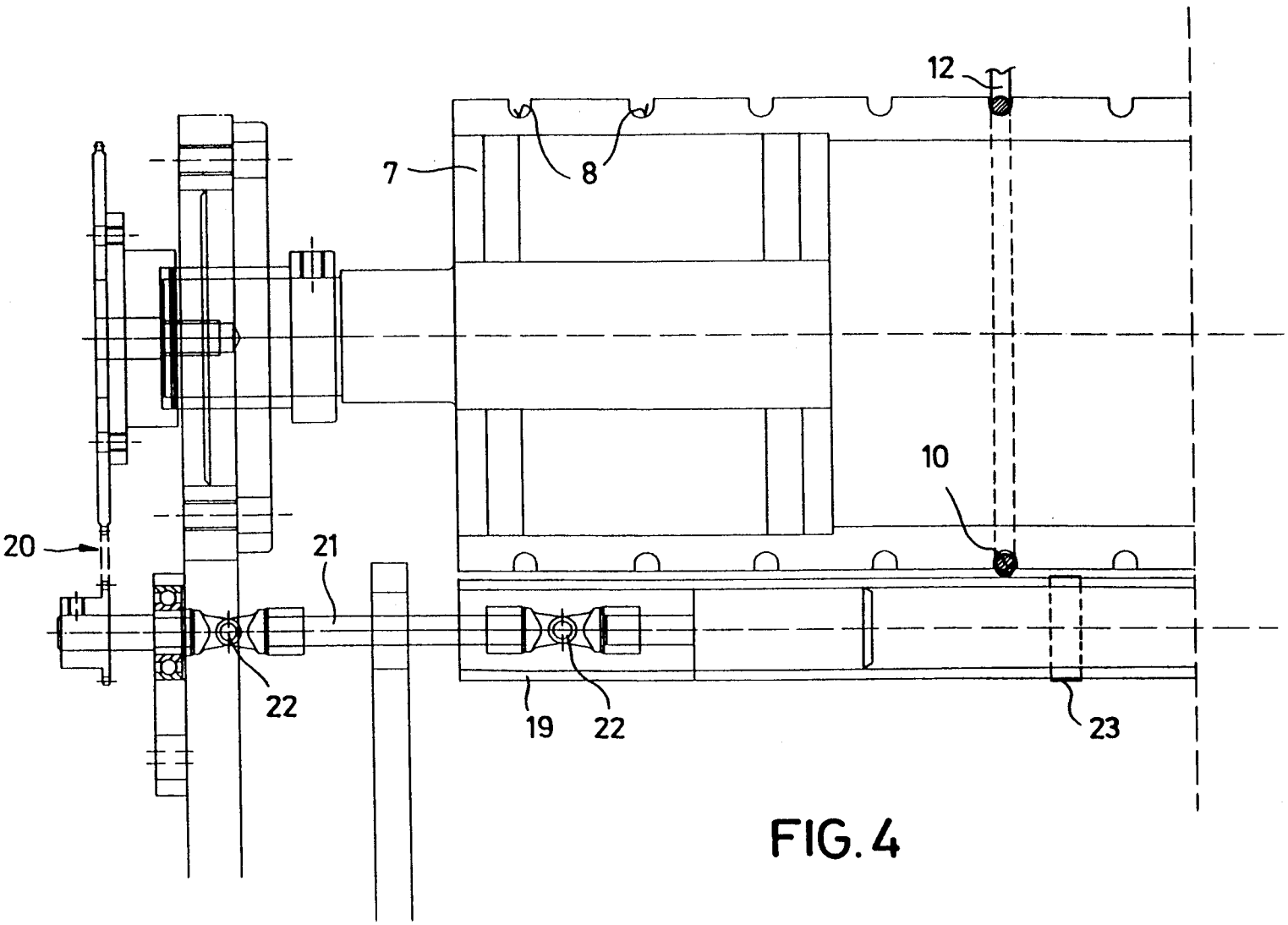

Embodiments of the above described invention are shown in FIG. 3 and 4. In the embodiment according to FIG. 3, the ribbons 23 are arranged at such locations of the transmission roller 19 which are opposite rings 10. Thus, the ribbons contact the non-rotating rings, so that a rotational frictional movement influences only the interior surface of the ribbons 23, i.e. from the transmission roller 19. In this solution the transmission roller 19 does not directly contact the finger roller 7 at all.

In the embodiment according to FIG. 4 the transmission roller 19 contacts the fingers 10, thus, not contacting the surface of the finger roller 7, and since the rings 10 consist of a friction-reduced material, better conditions also result as if the transmission roller 19 contacted the finger roller 7. The ribbons 23 can be located in flat circumferential grooves in the transmission roller, so that they can never be pinched between the transmission roller 19 and the finger roller 7.

Figure 5:
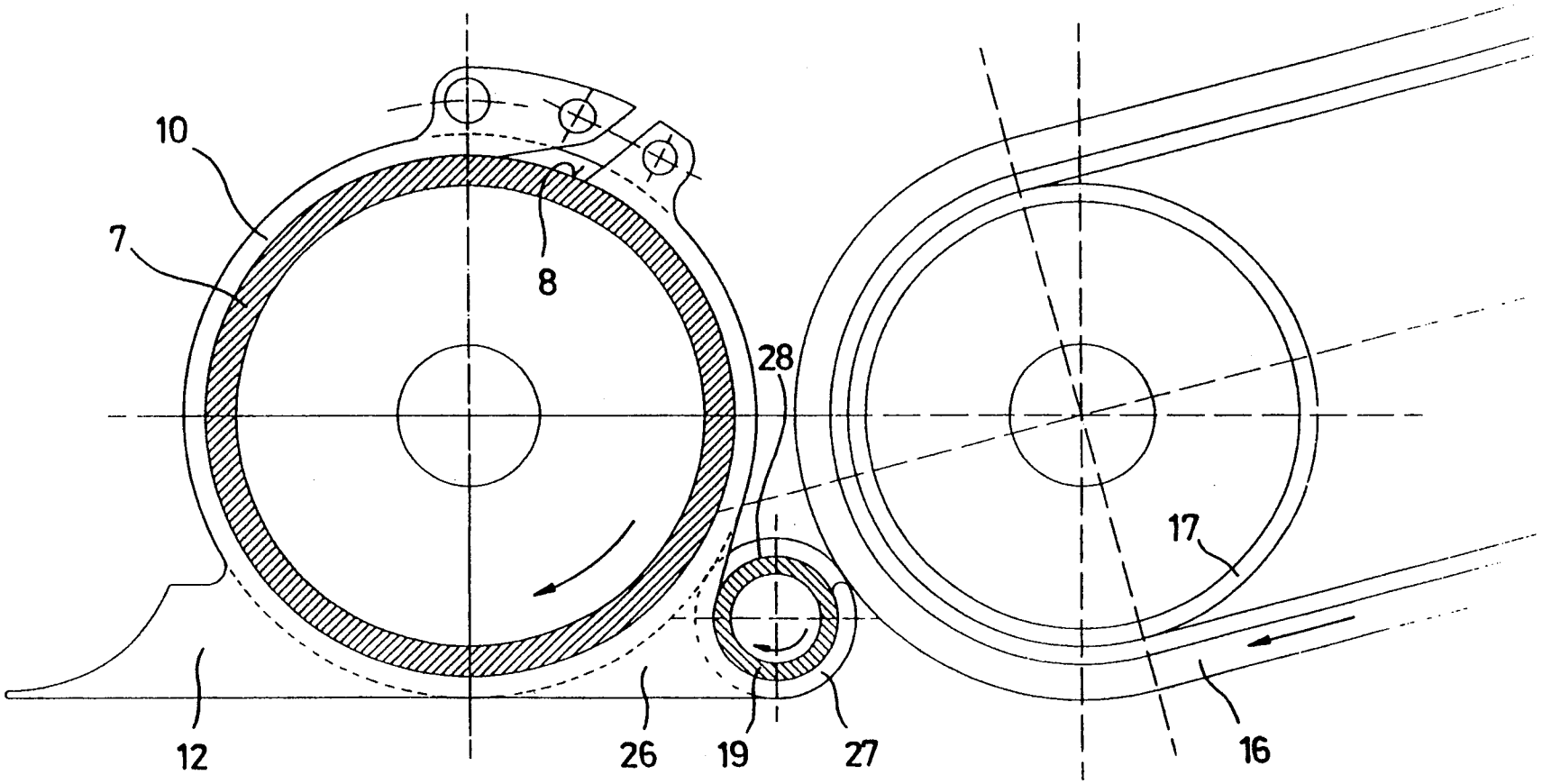
FIG. 5 is a radial sectional view showing schematically a second embodiment for the suspension of the upper transmission roller.

An alternative embodiment of the support of the transmission roller 19 is in sectional view schematically shown in FIG. 5. In this embodiment, some, preferably all of the rings 10 bearing the guide fingers 12 on the upper finger roller 7 are provided with holding fingers 26, which extend opposite to the guide fingers 12 towards the back, i.e. opposite the feed direction of the fiber batt and which end in upwardly bent, hook-like ends 27. The upper transmission roller 19 is inserted in these receptions of hook-like ends 27 and has for this purpose circumferential grooves 28 at the suitable locations, in which the hook-like ends 27 are located. The holding fingers 26 are located in one line, which is a tangent to the finger roller 7 and to the pre-compression band 16 guided over the reversing roller 17. The circumference of the upper transmission roller 19 can be situated in this tangent. It is, however, also advantageous, if it projects downwardly with respect to the tangent, so that the batt material can more effectively contact the transmission roller 19 and be transported by it. It can be seen, that the holding fingers 26 in addition to their holding function, can also take over a task comparable to that of the guide fingers 12, i.e. to bridge-over the gusset-like residual gap between the transmission roller 19 and the finger roller 7, so that, as can be seen, in the case of this embodiment only a minimum gusset gap remains at the reversing roller of the pre-compression band 16, which is not filled. A possible bulging of the fiber batt is so minimal that it is of no influence.

Figure 6:
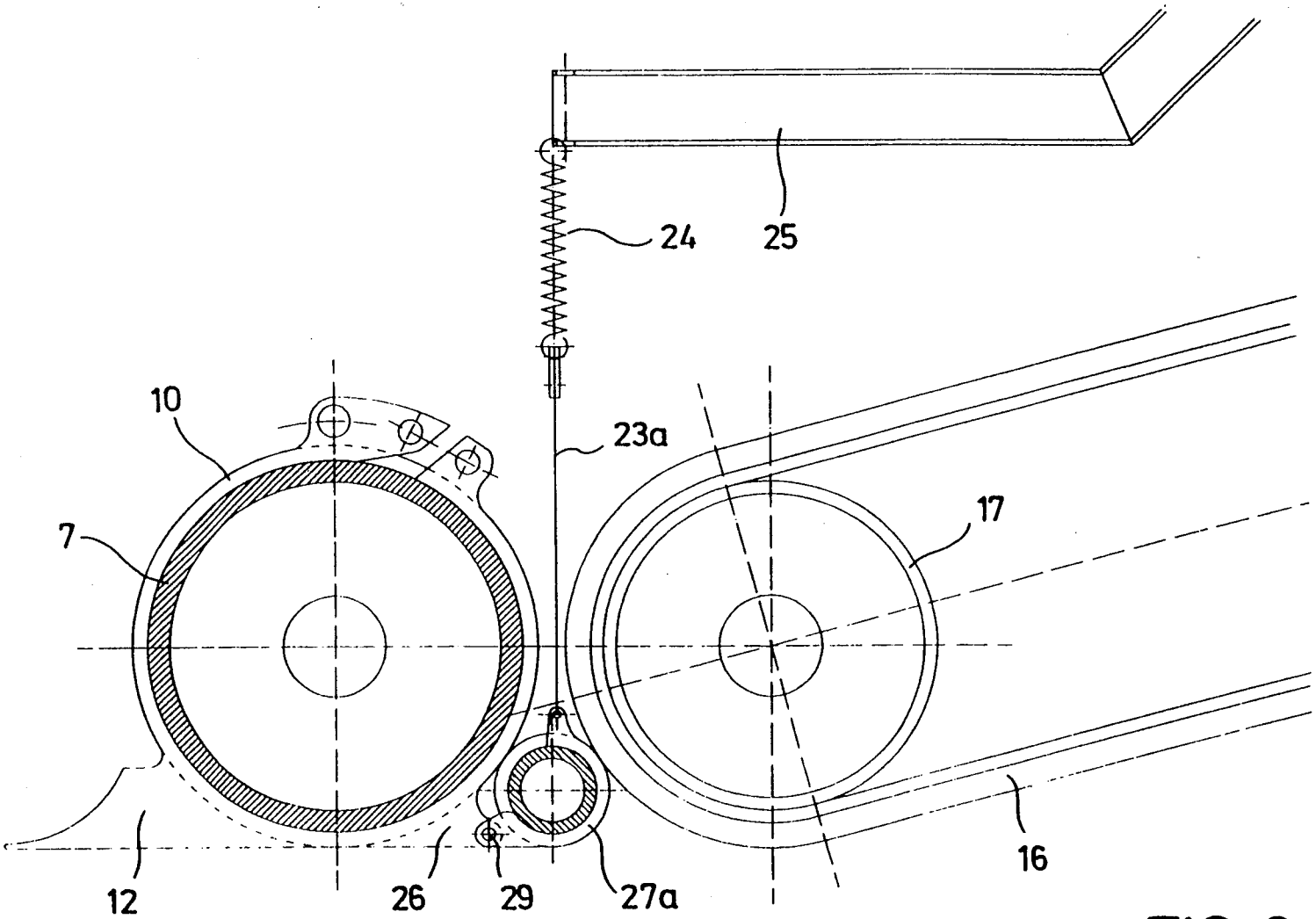
FIG. 6 is a radial sectional view of a modified embodiment of the suspension of the upper transmission roller.

FIG. 6 shows a modification of FIG. 5, in which the hook-like ends are formed as bows **27*a* flexibly arranged at pivot bearings 29 at the holding fingers 26, which are each suspended by a suspension means at their upper end, e.g. by means of a wire 23*a*, with the wire 23*a* extending through the gap between the pre-compression band 16 and the finger roller 7 in an upward direction and which are suspended at a spring means 24, which in turn is suspended at 25 at the machine frame, also compare FIG. 1. In this embodiment no attention need be paid to a minimum elasticity of the material of the existing units each comprising a ring 10, guide fingers 12, and holding fingers 26, since by pivoting down the bows 27*a*, the receptions for the transmission roller 19** formed by them can be slightly opened.

The material of these units can be selected under consideration of the weight of the transmission roller 19 supported thereby.

Figure 7:
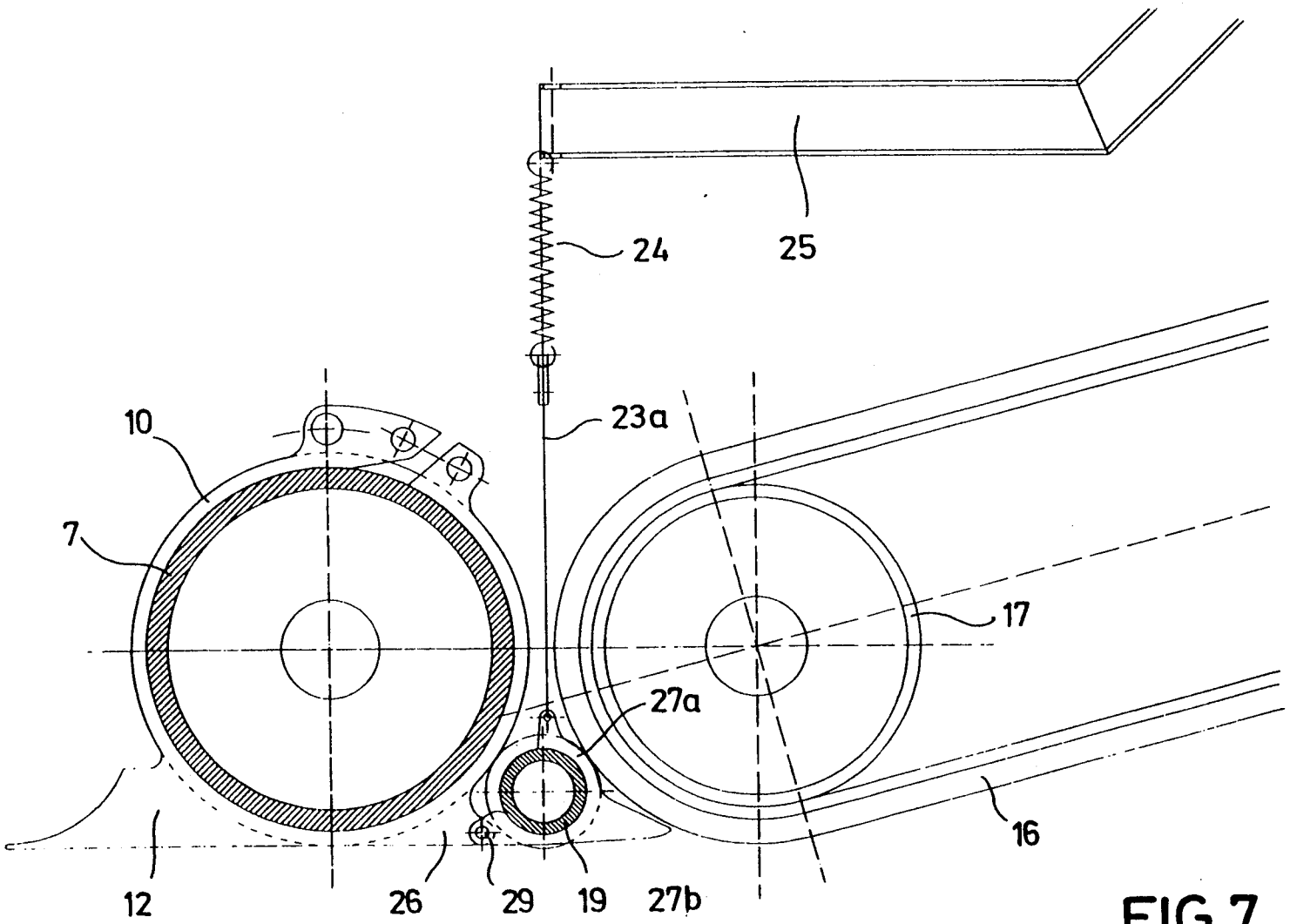
FIG. 7 is a radial sectional view of an embodiment similar to FIG. 6 having a residual gap bridge-over.

A further modification of the last two mentioned embodiments of the invention is shown in FIG. 7. The same parts are characterized by the same reference numerals, so that the description only refers to the differences. In this embodiment the bows **27*a* flexibly attached to the holding fingers 26 each have a flap 27*b* which projects over the transmission roller 19 opposite to the feed direction of the fiber batt. The lower rim of this flap lies in a line with the lower rim of the respective holding finger 26, so that all holding fingers 26 and flaps 27*b* form a continuous guide means for the fiber batt, in the middle section of which the transmission roller 19 is located. The circumference of which advantageously projects slightly downward between the holding fingers 26 and the flaps 27*b*, as shown, in order to improve the batt transport. The flaps 27*b* are formed in such a way that they bridge over-the gusset-like residual gap between the pre-compression band 16 and the transmission roller 19** to largest possible extent.

The drive of the transmission roller 19 can be carried out in one of the above mentioned kinds via chain drives.

The transmission roller 19 has a diameter in all embodiments of the invention which is sufficiently large to fill the gusset-gap to the largest possible extent. It is advantageously dimensioned in a way, that a deepest location on the circumference of the transmission roller 19 is located at least approximately in a line, which tangentially connects the finger roller 7 with the pre-compression conveyor band 16 surrounding the reversing roller 17, but preferably lies beneath this line, as can especially be seen in FIG. 7.

Figure 8:
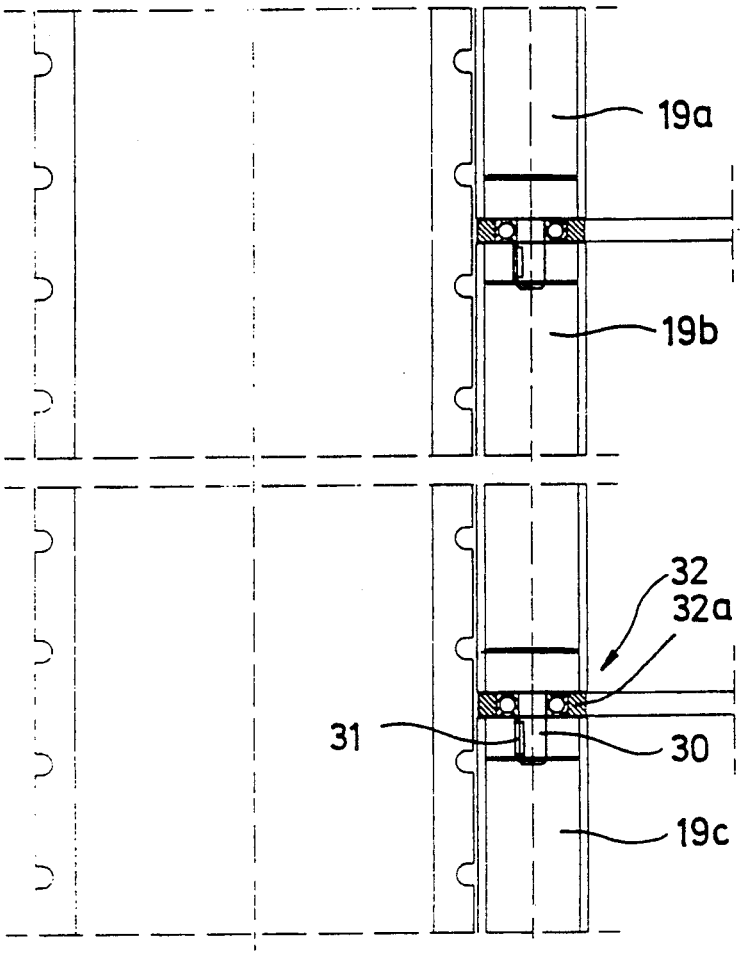
FIG. 8 is a top view, partially cut, of a further embodiment of the invention with transmission rollers divided into segments.
Figure 9:
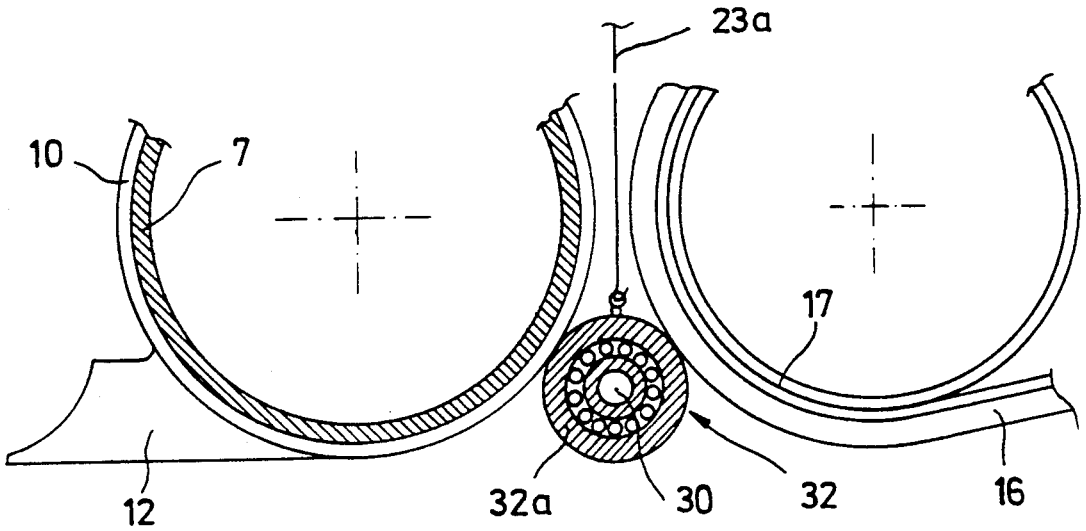
FIG. 9 is a radial sectional view of the embodiment of FIG. 8.

FIG. 8 shows in sectional view an embodiment of the above described invention, in which the transmission roller is divided into a plurality of segments **19*a*, 19*b*, 19*c*, which are arranged axially behind one another and which are fixedly connected to one another. The connection can e.g. be provided by means of journals 30, with feather keys 31, as shown, or cross bolts excluding a mutual turning of the segments 19*a*, 19*b*, and so on. At the connection positions of the roller segments 19*a*, 19*b*** and so on, bearing means 32 are each attached on the transmission roller 19, which are preferably put over the connection journals 30. The bearing means 32 are preferably roller bearings and their outer bearing bushes 32*a* are, as shown in FIG. 9, comparable to the embodiments according to FIGS. 6 and 7 suspended upwardly by means of wires 23*a* through the gap between the pre-compression band 16 and the finger roller 7. The advantage of this embodiment lies in the special lack of friction. This embodiment can for this purpose be combined with the lateral supports of the transmission roller 19 on the rings 10 according to FIG. 4, but is is also possible, to have the outer bearing bushes 32*a* contact the rings 10, in order to avoid a friction of the surface of the finger roller 7. In this case the transmission roller 19 does not contact the finger roller 7.

I claim:

1. Apparatus for feeding a fiber batt in a transport direction to a needle loom, comprising a pre-compression means including an outlet end and a batt support means, an endless continuously rotating pre-compression conveyor band arranged above the batt support means, a reversing roller for moving the conveyor band in the transport direction of the fiber batt at the outlet end of the precompression means, a lower supply roller and an upper supply roller mounted above the lower supply roller, said supply rollers forming a nip and being located between the pre-compression means and an intake of a needle loom, with the upper supply roller being proximal to said reversing roller, so that a gusset gap of approximately triangular cross-section is formed between the pre-compression band guided around the reversing roller and the upper supply roller, a transmission roller of low surface friction in said gusset gap, the circumference of said transmission roller being proximal to the surfaces of the pre-compression conveyor band and the upper supply roller, a plurality of bearing means distributed along said transmission roller to suspend said transmission roller to avoid sagging thereof, and means for driving said transmission roller in a direction in which the upper reversing roller and the upper supply roller are driven.

2. An apparatus according to claim 1 wherein a lowest tangent to the circumference of the transmission roller is approximately at the level of a line which forms a common tangent to the pre-compression band at the reversing roller and the upper supply roller.

3. An apparatus according to claim 2 wherein the diameter of the transmission roller is approximately ¼ of the diameter of the upper supply roller.

4. An apparatus according to claim 1 wherein the transmission roller is suspended by several narrow, thin, flexible ribbons of low surface friction which directly contact the surface of the transmission roller and which extend upwardly through a gap between the pre-compression conveyor band and the upper supply roller.

5. An apparatus according to claim 4 wherein the ribbons are located in flat circumferential grooves of the transmission roller.

6. An apparatus according to claim 4 wherein the ribbons are comprised of a material selected from the group consisting of polytetrafuoroethylene, polyethylene, highly-drawn polyethylene with an outer coating of polytetrafuoroethylene.

7. An apparatus according to claim 5 wherein the ribbons are comprised of a material selected from the group consisting of polytetrafuoroethylene, polyethylene, highly-drawn polyethylene, and polyethylene with an outer coating of polytetrafuoroethylene.

8. An apparatus according to claim 1 wherein the upper supply roller is a finger roller having a plurality of circumferential groves distributed along its length, an open ring in each said groove, each said open ring having a guide finger extending tangentially in a direction towards a needle loom, said guide fingers bridging over a second gusset gap between the upper supply roller and the needle loom, the rings each having an outer diameter which is slightly larger than that of the upper supply roller, the transmission roller contacting the rings.

9. An apparatus according to claim 4 wherein the upper supply roller is a finger roller having a plurality of circumferential grooves regularly distributed along its length, an open ring in each of said grooves, a guide finger extending tangentially in a direction towards a needle loom from each ring, said fingers bridging over a second gusset gap formed between the upper supply roller and the needle loom, said rings each having an outer diameter slightly larger than that of the upper supply roller, the ribbons holding the transmission roller contacting said rings.

10. An apparatus according to claim 5 wherein the upper supply roller is a finger roller having a plurality of circumferential grooves regularly distributed along its length, an open ring in each of said grooves, a guide finger extending tangentially in a direction towards a needle loom from each ring, said fingers bridging over a second gusset gap formed between the upper supply roller and the needle loom, the rings each having an outer diameter slightly larger than that of the upper supply roller, the ribbons holding the transmission roller contacting said rings.

11. An apparatus according to claim 1, wherein the upper supply roller is a finger roller having a plurality of circumferential grooves regularly distributed along its length, an open ring in each said groove, a guide finger extending tangentially from each open ring in a direction towards the needle loom, the guide fingers bridging over a second gusset gap formed between the upper supply roller and the needle loom, a holding finger extending opposite to the guide fingers, from at least one of the rings into a gusset gap between the transmission roller and the upper supply roller, a free end of each holding finger having a hook bent upwardly, said hook forming a reception which is open in an upward direction, the transmission roller being provided with circumferential grooves at several locations regularly distributed along its length in which said holding fingers and hooks are located, the holding fingers opening tangentially into the circumference of the transmission roller.

12. An apparatus according to claim 11 wherein the transmission roller is elastically locked in each hook.

13. An apparatus according to claim 11 wherein the hooks are bows flexibly arranged at the holding fingers, upper ends of the hooks being suspended through the gap between the pre-compression band and the finger roller by suspension means.

14. An apparatus according to claim 11 wherein the hooks are elongated by flaps in a direction towards the pre-compression conveyor band, lower edges of the holding fingers and the flaps being located on a common level beyond which the circumference of the transmission roller extends downwardly.

15. An apparatus according to claim 11 wherein all of said rings are provided with holding fingers.

16. An apparatus according to claim 12 wherein all of said rings are provided with holding fingers.

17. An apparatus according to claim 1 wherein the transmission roller is comprised of several segments arranged axially behind one another and fixedly connected to one another, and wherein bearing means are provided at the connection positions of the segments, said bearing means being suspended through a gap between the precompression conveyor band and the upper supply roller by suspension means.

18. An apparatus according to claim 17 wherein said bearing means are roller bearings having outer bearing bushes suspended by wires.

19. An apparatus according to claim 1 wherein the transmission roller is suspended at locations spaced from one another by substantially 50 cm.

20. Apparatus for feeding a fiber batt in a transport direction to a needle loom, comprising a pre-compression means including an outlet end and a batt support means, an endless continuously rotating pre-compression conveyor band arranged above the batt support means, a reversing roller for moving the conveyor band in the transport direction of the fiber batt at the outlet end of the precompression means, a lower supply roller and an upper supply roller mounted above the lower supply roller, said supply rollers forming a nip and being located between the pre-compression means and an intake of a needle loom, with the upper supply roller being proximal to said reversing roller, so that a gusset gap of approximately triangular cross-section is formed between the pre-compression band guided around the reversing roller and the upper supply roller, a transmission roller of low surface friction in said gusset gap, the circumference of said transmission roller contacting at least one of said pre-compression conveyor band and upper supply roller, a plurality of bearing means distributed along said transmission roller to suspend said transmission roller to avoid sagging thereof, and means for driving said transmission roller in a direction in which the upper reversing roller and the upper supply roller are driven.

* * * * *